US009808844B2

(12) United States Patent
Frobose et al.

(10) Patent No.: US 9,808,844 B2
(45) **Date of Patent: *Nov. 7, 2017**

(54) METHOD FOR PRODUCING A STEEL TUBE INCLUDING CLEANING OF THE OUTER TUBE WALL

(71) Applicant: SANDVIK MATERIALS TECHNOLOGY DEUTSCHLAND GMBH, Dusseldorf (DE)

(72) Inventors: Thomas Frobose, Versmold (DE); Udo Rauffmann, Werther (DE)

(73) Assignee: Sandvik Materials Technology Deutschland GMBH, Düsseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/778,123

(22) PCT Filed: Mar. 11, 2014

(86) PCT No.: PCT/EP2014/054729

§ 371 (c)(1),
(2) Date: Sep. 18, 2015

(87) PCT Pub. No.: WO2014/146935

PCT Pub. Date: Sep. 25, 2014

(65) Prior Publication Data

US 2016/0279688 A1 Sep. 29, 2016

(30) Foreign Application Priority Data

Mar. 18, 2013 (DE) ..... 10 2013 102 703

(51) Int. Cl.
*B21B 45/02* (2006.01)
*B08B 7/00* (2006.01)
(Continued)

(52) U.S. Cl.
CPC ..... *B21B 45/0284* (2013.01); *B08B 7/0021* (2013.01); *B08B 7/0092* (2013.01);
(Continued)

(58) Field of Classification Search
CPC ..... B21B 45/0284; B21B 45/0269; B21B 45/0275; B21B 45/0278; B21B 45/0281;
(Continued)

(56) References Cited

U.S. PATENT DOCUMENTS 4,311,789 A 1/1982 Nylen et al.
4,739,640 A 4/1988 Hurst et al.
(Continued)

FOREIGN PATENT DOCUMENTS

CN 202700985 U 1/2013
DE 102008003494 A1 7/2009
(Continued)

OTHER PUBLICATIONS

Keeney C A et al: "Cryogenic Blast Cleaning", Aise Steel Technology, Aise, Pittsburgh, PA, US. vol. 75 No. 1, Jan. 1, 1998, p. 56/57, XP00732788.
(Continued)

*Primary Examiner* — R.K. Arundale
*Assistant Examiner* — Mohammad Yusuf
(74) *Attorney, Agent, or Firm* — Morgan, Lewis & Bockius LLP

(57) ABSTRACT

A method for producing a steel tube include the manufacturing of a steel tube having an inner tube wall, an outer tube wall (3), and a free tube cross-section enclosed by the inner tube wall. After the manufacturing, the steel tube includes at least one contaminant on the outer tube wall and entails, after the manufacturing of the steel tube, cleaning of the
(Continued)

outer tube wall by applying liquid or solid $CO_2$ onto the outer tube wall in order to remove a contaminant from the outer tube wall.

13 Claims, 2 Drawing Sheets

(51) Int. Cl.
*B21B 21/00* (2006.01)
*B21B 38/00* (2006.01)

(52) U.S. Cl.
CPC ..... *B21B 21/00* (2013.01); *B21B 38/006* (2013.01); *B08B 2209/02* (2013.01)

(58) Field of Classification Search
CPC . B21B 45/0287; B08B 7/0092; B08B 7/0021; B08B 2209/02
USPC ..... 134/18, 6, 22.11, 42, 22.12, 30, 34, 17, 134/35
See application file for complete search history.

(56) References Cited

U.S. PATENT DOCUMENTS 5,580,845 A * 12/1996 Ruane ..... C10M 169/04 508/161
5,592,863 A 1/1997 Jaskowiak et al.
5,626,050 A 5/1997 Ploughe et al.
5,637,027 A * 6/1997 Palombo ..... B05B 12/004 134/11
5,778,744 A 7/1998 Braun et al.
6,382,886 B1 5/2002 Jaeger
7,056,391 B2 * 6/2006 Banerjee ..... B08B 3/04 134/1.3
7,513,121 B2 4/2009 Zurecki et al.
2005/0160552 A1 * 7/2005 Yoshida ..... B08B 5/02 15/316.1
2005/0217706 A1 * 10/2005 Banerjee ..... H01L 21/02063 134/26
2011/0232352 A1 * 9/2011 Hayashi ..... B21C 1/22 72/283
2013/0209186 A1 8/2013 Quintard et al.
2015/0314374 A1 11/2015 Frobose
2015/0321258 A1 11/2015 Frobose
2016/0193640 A1 7/2016 Frobose et al.

FOREIGN PATENT DOCUMENTS

EP 0094740 A1 11/1983
EP 0098492 A2 1/1984
EP 0612834 A1 8/1994
EP 0645208 A1 3/1995
EP 1044762 A2 10/2000
EP 1208940 A2 5/2002
EP 1580284 A2 9/2005
GB 2106819 A 4/1983
GB 2199519 A 7/1988
JP S5992115 A 5/1984
WO 2004033154 A1 4/2004
WO 2012/052650 A1 4/2012

OTHER PUBLICATIONS

Notification of the Second Office Action dated Jun. 2, 2017, for Chinese Patent Application No. 201480017004.9.
Notification of the Second Office Action dated May 31, 2017, for corresponding Chinese Patent Application No. 201480017005.3.
Communication pursuant to Article 94(3) EPC dated Apr. 13, 2017 issued in related European Patent Application No. 14709637.4.

* cited by examiner

METHOD FOR PRODUCING A STEEL TUBE INCLUDING CLEANING OF THE OUTER TUBE WALL

RELATED APPLICATION DATA

This application is a §371 National Stage Application of PCT International Application No. PCT/EP2014/054729 filed Mar. 11, 2014 claiming priority of DE Application No. 102013102703.2, filed Mar. 18, 2013.

The present invention relates to a method for producing a steel tube comprising the manufacturing of a steel tube with an inner tube wall, an outer tube wall, and a free tube cross section enclosed by the inner tube wall, wherein after the manufacturing, the steel tube comprises at least one contaminant on the outer tube wall and entailing, after the manufacturing of the steel tube, cleaning of the outer tube wall.

For producing high precision metal tubes, particularly metal tubes made of steel, an expanded hollow cylindrical blank in the completely cooled state is subjected to cold reduction by compressive- or tensile stress. In the process, the blank is formed into a tube having a defined reduced outer diameter and a defined wall thickness.

The most commonly used method for reducing tubes is known as cold pilgering, wherein the blank is referred to as a hollow shell. The hollow shell is pushed during the rolling over a calibrated rolling mandrel, i.e., a rolling mandrel having the inner diameter of the finished tube, and in the process it is gripped from the outside by two calibrated rolls, i.e., rolls that define the outer diameter of the finished tube, and rolled in the longitudinal direction over the rolling mandrel.

During cold pilgering, the hollow shell is fed step-wise in the direction of the rolling mandrel and over and past the latter, while the rolls are moved back and forth horizontally as they rotate, over the mandrel and thus over the hollow shell. In the process, the horizontal movement of the rolls is predetermined by a roll stand, on which the rolls are rotatably mounted. In known cold pilger rolling mills, the roll stand is moved back and forth by means of a crank drive in a direction parallel to the rolling mandrel, while the rolls themselves are set in rotation by a rack which is stationary relative to the roll stand, and with which toothed wheels that are firmly connected to the roll axles engage.

The feeding of the hollow shell over the mandrel occurs by means of a feeding clamping carriage, which is set in translational motion in a direction parallel to the axle of the rolling mandrel.

The conically calibrated rolls arranged one above the other in the roll stand rotate opposite to the feeding direction of the feeding clamping carriage. The so-called pilger mouth, which is formed by the rolls, grips the hollow shell, and the rolls push off a small wave of material outward, which is stretched out by the smoothing pass of the rolls and by the rolling mandrel to the intended wall thickness, until the idle pass of the rolls releases the finished tube. During the rolling, the roll stand with the rolls attached to it moves opposite to the feeding direction of the hollow shell. By means of the feeding clamping carriage, the hollow shell is advanced by an additional step onto the rolling mandrel, after the idle pass of the rolls has been reached, while the rolls with the roll stand return to their horizontal starting position. At the same time, the hollow shell undergoes a rotation about its axis, in order to achieve a uniform shape of the finished tube. As a result of repeated rolling of each tube cross section, a uniform wall thickness and roundness of the tube as well as uniform inner and outer diameters are achieved.

In order to reduce the friction between the rolls the hollow shell during the forming, a lubricant is applied to rolls. After the forming, this lubricant adheres at least partially to the outer tube wall of the finished tube. While such a contaminant of the outer tube wall consisting of residual mandrel bar lubricant is unimportant for some applications of the finished tubes, for other applications the outer tube wall has to be cleaned at great cost.

However, similar contaminants of the outer tube wall also appear in alternative forming techniques, such as tube drawing, for example.

In tube drawing, an already tubular blank is formed in a cold state on a drawing bench so that it receives the desired dimensions. However, not only does the drawing allow a precise dimensioning of the finished tube, which is adjustable at will, but the cold forming also achieves a hardening of the material, i.e., its yield limit and strength are increased, while at the same time its elongation properties become smaller. This optimization of the material properties is a desired effect of tube drawing for many application purposes, for example, in high-pressure technology and medical technology, in aircraft construction, but also in general machine construction.

Here, applying the $CO_2$ in the sense of the present invention means that the $CO_2$ is brought in contact or engagement with the outer wall or the contaminant.

Depending on the material used, a distinction is made between the so-called hollow drawing, the core drawing, and the bar drawing. Whereas in the case of hollow drawing only the outer diameter of the tube is reduced in a tool referred to as a drawing ring or drawing die, in the case of core drawing and bar drawing, the inner diameter and the wall thickness of the drawn tube are also defined.

An undesired effect during the cold drawing of tubes is the so-called rattling. Here, due to high friction between the tool and the tube to be drawn, an irregular drawing speed occurs. In the most disadvantageous case, the tube moves intermittently or not at all relative to the tool or at a high speed. As a result of the rattling, grooves form, particularly on the inner surface of the drawn tube.

To achieve uniform drawing speeds and to prevent rattling, drawing oils are therefore used in order to reduce the sliding friction between the tube to be drawn and the tools.

From the state of the art, various methods for cleaning the outer tube wall of a steel tube are known. Thus, for example, the entire tube can be dipped in a solvent, which then dissolves the contaminant on the outer tube wall. In an alternative embodiment of the prior art, the tube is cleaned mechanically with a cloth and a felt.

In comparison to this prior art, the aim of the invention is to provide a method for cleaning a steel tube, which makes it possible to effectively clean tubes having long lengths, so that the outer tube wall is free of contaminants.

The above-mentioned aim is solved by a method for producing a steel tube with an inner tube wall, an outer tube wall, and a free tube cross section enclosed by the inner tube wall, wherein after the manufacturing, the steel tube comprises at least one contaminant on the outer tube wall and wherein, after the manufacturing of the steel tube, the outer tube wall is cleaned by applying liquid or solid $CO_2$ to the outer tube wall in order to remove a contaminant from the outer tube wall.

Surprisingly, it has been found that applying liquid or solid $CO_2$ to the outer tube wall is quite suitable for removing the contaminant from a said outer tube wall and thus for cleaning the outer tube wall of the tube.

While it is possible in principle to clean the inner tube wall alternatively with liquid or solid $CO_2$, liquid $CO_2$ tends to have the disadvantage that, at the time of contact between the liquid $CO_2$ and the wall to be cleaned, a gas film forms between the wall and the liquid $CO_2$, which reduces the cleaning action.

In comparison, solid $CO_2$ not only exhibits an advantageous heat transfer from the solid $CO_2$ to the tube wall to be cleaned or the contaminant, and thus an improved cleaning action, but the solid $CO_2$ also has an abrasive effect, so that, when solid $CO_2$ is used, the method is a blasting cleaning method.

When using solid $CO_2$ for cleaning the outer tube wall, one distinguishes between, on the one hand, a so-called $CO_2$ snow blasting, and, on the other hand, a so-called dry ice blasting. The difference between the two methods is that, in the case of $CO_2$ snow blasting, the solid $CO_2$ is generated in the process itself. In this process, a carrier gas or a driving jet is passed under pressure through a jet line to a jet nozzle, and liquid $CO_2$ is supplied via a feed line, converted by pressure reduction into dry snow, and fed into the jet line, wherein the $CO_2$ from the feed line is introduced through a pressure reduction space having a widened cross section into the jet line. Such a method is known from WO 2004/033154 A1, for example. On the other hand, in the case of dry ice blasting, already solid $CO_2$ is supplied to the process and accelerated therein onto the surface to be cleaned, in this case the outer tube wall.

In an embodiment, the liquid or solid $CO_2$ is accelerated onto the outer wall of the steel tube by means of a pressurized fluid, preferably pressurized air.

Moreover, for cleaning the outer tube wall it is advantageous for the liquid or solid $CO_2$ to be applied in the form of a jet onto the outer tube wall, wherein the jet direction of the $CO_2$ is preferably substantially perpendicular to the outer tube wall.

In such blasting of the outer tube wall of the steel tube, it has been found to be advantageous if the temperature of the jet is measured in the jet direction behind the steel tube. The temperature of the $CO_2$ that has already been used in the cleaning process, i.e., after the interaction with the steel tube, is an indicator of the effectiveness of the cleaning process.

In an embodiment of the invention, the temperature measurement value is used in order to determine whether the tube has been cleaned effectively or not. If the measured temperature is above a certain temperature threshold, i.e., if the jet behind the tube is excessively warm, then, in an embodiment, it is assumed that the cleaning was not effective, and the cleaning process is repeated or the cleaning parameters are changed.

If, in an additional embodiment, the measured temperature is below a certain temperature threshold, i.e., if the jet behind the tube is excessively cold, then it is assumed that the cleaning was not effective, and the cleaning process is repeated or the cleaning parameters are changed. In this case, it must be assumed that sufficient interaction has not occurred between the $CO_2$ and the steel tube to be cleaned, or that the tube is already frozen.

In an embodiment of the invention, it is assumed that the cleaning was effective if the measured temperature is below a certain first temperature threshold and above a certain second temperature threshold.

In an additional embodiment of the invention, the speed of the liquid or solid $CO_2$ as it exits a feed line is regulated as a function of the temperature of the jet in the jet direction of the liquid or solid $CO_2$ behind the steel tube. For example, if the temperature falls below a predetermined temperature threshold, then the jet speed is increased in an embodiment.

For the method according to the invention it is not important what time delay exists between the manufacturing of the tube, i.e., the forming process, and the cleaning of the tube. In particular, the method according to the invention can be used in production line manufacturing, wherein the manufacturing and the cleaning occur temporally immediately one after the other. Alternatively, it is also possible for considerably longer time periods, on the order of magnitude of days, weeks or months, to be inserted between the manufacturing and the cleaning.

In an embodiment of the method, during the application of the liquid or of solid $CO_2$, the temperature of the steel tube is measured, and the cleaning is interrupted if the temperature of the steel tube falls below a predetermined temperature threshold.

It has been shown that the temperature of a tube cleaned with liquid or solid $CO_2$ is a measure of the cleaning of the tube that has already occurred, i.e., of the cleanliness of the tube. Thus, if the temperature of the tube to be cleaned falls below a certain temperature threshold, then it can be assumed that the tube has reached a desired degree of cleanliness, and that the cleaning with the liquid or solid $CO_2$ can be interrupted.

It is assumed that, when cleaning the outer tube wall, first a heat transfer occurs from the contaminant to the liquid or solid $CO_2$, so that, as long as the tube is still contaminated, the tube itself stays at substantially constant temperature, or on the other hand it undergoes only a slight cooling. It is only when the contaminant has been largely removed from the outer tube wall that a heat transfer from the tube itself to the liquid or solid $CO_2$ occurs, so that the tube undergoes further cooling.

Here, in an embodiment, the manufacturing of the steel tube occurs in particular by forming, preferably cold forming, a hollow shell to the form of the finished dimensioned steel tube. This forming can occur according to the invention either by cold pilgering the hollow shell to the form of the finished steel tube or by cold drawing the hollow shell to the form of the finished steel tube.

If the forming occurs by cold pilgering the hollow shell to the form of the finished steel tube, then, in an embodiment, a lubricant is transferred during the cold pilgering from a roll of the cold pilger rolling mill to the outer tube wall, and is then removed again from the outer tube wall by applying the liquid or solid $CO_2$.

On the other hand, if the forming occurs by cold drawing the hollow shell to the form of the finished steel tube, then, in an embodiment, a drawing oil is transferred during the cold drawing from a die to the outer tube wall, and is then removed again from the outer tube wall by applying the liquid or solid $CO_2$.

In an embodiment of the invention, the steel tube is a stainless steel tube, preferably a round tube made of stainless steel.

Additional advantages, features and application possibilities of the present invention become apparent on the basis of the following description of an embodiment and the associated figures.

Figure 1:
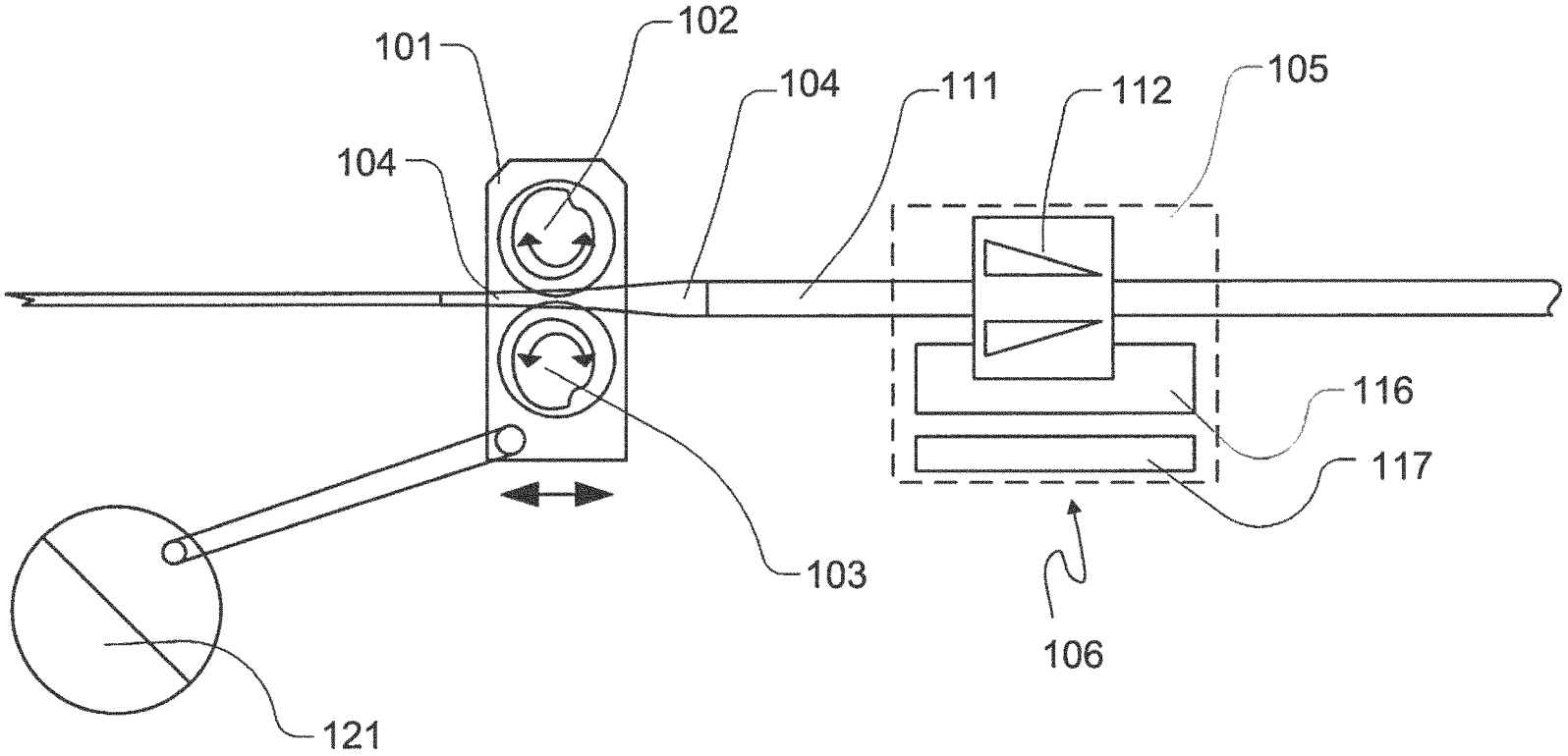
FIG. 1 shows the cold pilger rolling mill from the prior art in a schematically side view.

In FIG. 1, the structure of a cold pilger rolling mill is represented schematically in a side view. Here, the description of cold pilgering is used as an example of the manufacturing of the steel tube and as an example of how a contaminant can occur on the outer tube wall of the steel tube, which then has to be removed subsequently from the outer tube wall.

The rolling mill consists of a roll stand 101 with rolls 102, 103, a calibrated rolling mandrel 104 as well as a feeding clamping carriage 105. In the represented embodiment, the cold pilger rolling mill comprises a linear motor 106 as direct drive for the feeding clamping carriage 105. The linear motor 106 is constructed from a rotor 116 and a stator 117.

During the cold pilgering in the rolling mill shown in FIG. 1, the hollow shell 111 is fed step-wise in the direction of the rolling mandrel 104 and over and past the latter, while the rolls 102, 103 as they rotate are moved horizontally back and forth over the mandrel 104 and thus over the hollow shell 111. In the process, the horizontal movement of the rolls 102, 103 is predetermined by a roll stand 101 on which the rolls 102, 103 are rotatably mounted. The roll stand 101 is moved back and forth by means of a crank drive 121 in a direction parallel to the rolling mandrel 104, while the rolls 102, 103 themselves are set in rotation by a rack which is stationary relative to the roll stand 101, and with which toothed wheels that are firmly connected to the roll axles engage.

The feeding of the hollow shell 111 over the mandrel 104 occurs by means of the feeding clamping carriage 105, which allows a translational movement in a direction parallel to the axis of the rolling mandrel. The conically calibrated rolls 102, 103 arranged one above the other in the roll stand 101 rotate against the feeding direction of the feeding clamping carriage 105. The so-called pilger mouth formed by the rolls grips the hollow shell 111 and the rolls 102, 103 push off a small wave of material from outside, which is stretched by a smoothing pass of the rolls 102, 103 and by the rolling mandrel 104 to the predetermined wall thickness, until an idle pass of the rolls 102, 103 releases the finished tube. During the rolling, the roll stand 101 with the rolls 102, 103 attached to it moves against the feeding direction of the hollow shell 111. By means of the feeding clamping carriage 105, the hollow shell 111 is fed by an additional step onto the rolling mandrel 104, after the idle pass of the rolls 102, 103 has been reached, while the rolls 102, 103 with the roll stand 101 return to their horizontal starting position. At the same time, the hollow shell 111 undergoes a rotation about its axis, in order to reach a uniform shape of the finished tube. As a result of multiple rollings of each tube section, a uniform wall thickness and roundness of the tube as well as uniform inner and outer diameters are achieved.

In order to reduce the friction between the rolls 102, 103 and the hollow shell 111, a lubricant, for example, a graphite-containing lubricant, is applied onto the rolls 102, 103. This lubricant forms residues on the outer tube wall of the finished reduced tube. The aim is to remove this residue from the outer tube wall over the entire length of the tube by means of the process steps according to the invention described below.

In the embodiment of the invention described here as an example, the cold pilger rolling mill is used in order to manufacture the steel tube, i.e., in order to form the hollow shell to the form of the finished tube. Alternatively, this forming step of the invention could, however, also occur in particular by cold drawing of the hollow shell.

Figure 2:
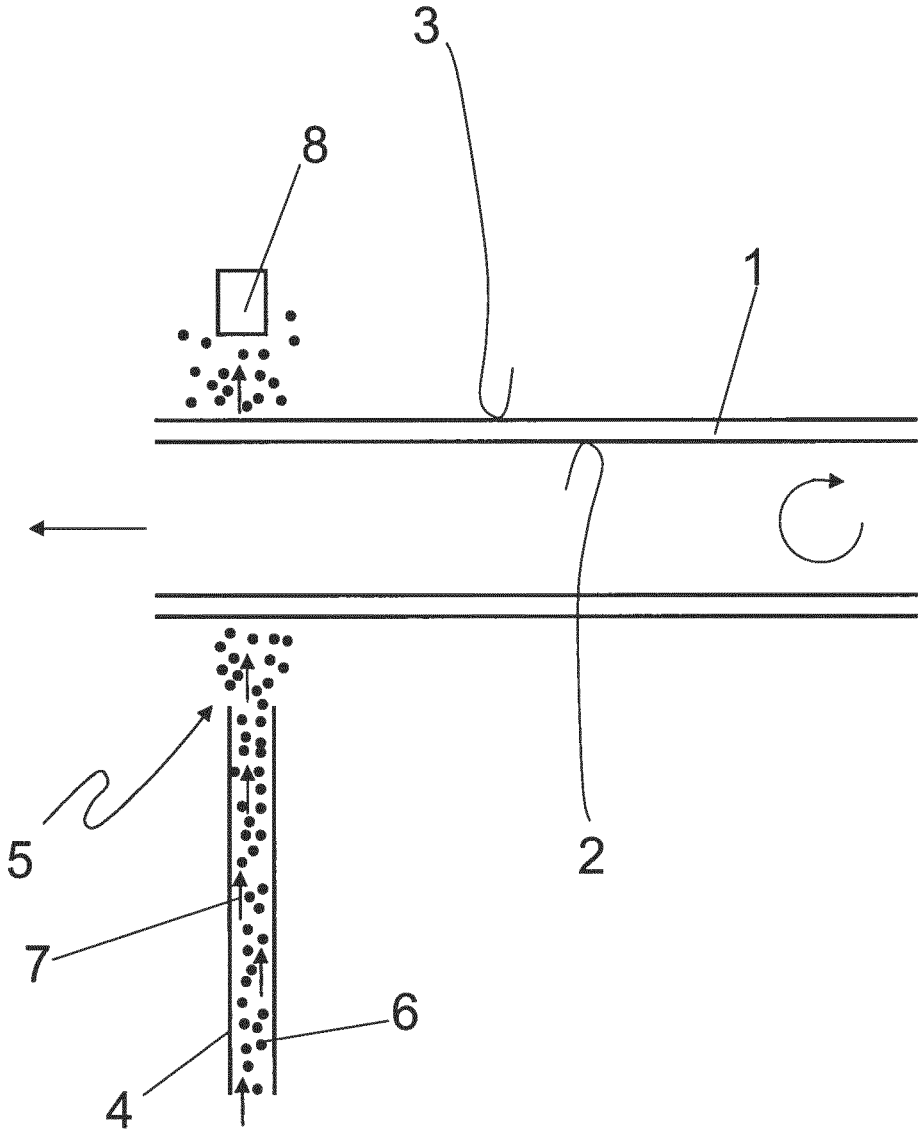
FIG. 2 shows a schematically cross-sectional view of an embodiment for carrying out the cleaning steps according to the invention.

FIG. 2 shows a dry ice blasting of the outer tube wall 3 of a finished reduced tube 1 obtained by cold pilgering. In this dry ice blasting, lubricant is cleaned from the tube 1 which has been contaminated on its outer tube wall 3 during the cold pilgering.

For this purpose, a cleaning lance 4 is directed onto the tube 1. Through the cleaning lance 4, dry snow 6 is fed by means of pressurized air 7 to the tube 1, and accelerated or blasted through an through outlet nozzle 5 onto the outer tube wall 3, so that the outer wall 3 is cleaned by means of the dry snow.

As indicated by the arrows, the tube 1 is rotated about its axis during cleaning and moved linearly past the outlet nozzle 5 of the cleaning lance. However, it is unimportant here whether the tube moves or the cleaning lance 4 moves, as long as the jet of dry snow interacts during the cleaning process with the outer wall 3 over the entire length of the tube. During the cleaning process, the tube 1 is additionally rotated about its axis, so that the tube is cleaned over its entire periphery.

In the represented embodiment, the temperature of the jet made of dry snow and pressurized air is measured by means of a temperature sensor 8 in the jet direction behind the tube 1, i.e., after the interaction of the dry snow 6 with the outer tube wall 3.

As a result, the temperature of the "waste gas jet" behind the tube 1 is used as an indicator of whether the outer tube wall 3 has been cleaned effectively or not. If the temperature of the waste gas jet is outside of a certain temperature window, which is defined by a first upper temperature threshold and a second lower temperature threshold, then it must be assumed that the cleaning was not effective, and the cleaning process is repeated.

For the purpose of the original disclosure, reference is made to the fact that all the features, as they are disclosed to a person skilled in the art from the present description, the drawings and the claims, even if they have been described in concrete terms only in connection with certain additional features, can be combined both individually and also in any desired combinations with other features or groups of features disclosed here, to the extent that this is not explicitly excluded, or to the extent that technical circumstances make such combinations impossible or unreasonable. A comprehensive, explicit description of all the conceivable combinations of features is omitted here only for the sake of the brevity and readability of the description.

While the invention has been represented and described in detail in the drawings and in the above description, this representation and this description occur only by way of example and are not intended to limit the scope of protection as defined by the claims. The invention is not limited to the embodiments that have been disclosed.

Variant forms of the disclosed embodiments are evident to the person skilled in the art from the drawings, the description and the appended claims. In the claims, the word "comprise" does not exclude other elements or steps, and the indefinite article "an" or "a" does not exclude a plural. The mere fact that certain features are claimed in different claims does not rule out their combination. Reference numerals in the claims are not intended to limit the scope of protection.

LIST OF REFERENCE NUMERALS

1 Tube
2 Inner tube wall
3 Outer tube wall
4 Cleaning lance

5 Outlet nozzle
6 Dry snow
7 Pressurized air
8 Temperature sensor
101 Roll stand
102, 103 Roll
104 Rolling mandrel
105 Feeding clamping carriage
106 Linear motor
111 Hollow shell
112 Chuck
116 Rotor
117 Stator

The invention claimed is:

1. A method for producing a steel tube comprising:

manufacturing the steel tube by forming a hollow shell into a form of a finished dimensioned steel tube by cold pilgering, the steel tube having an inner tube wall, an outer tube wall, and a free tube cross-section enclosed by the inner tube wall, wherein after the manufacturing, the steel tube on the outer tube wall includes at least one contaminant, the at least one contaminant being a lubricant transferred from a roll to the outer tube wall; and cleaning the outer tube wall of the steel tube by applying liquid or solid $CO_2$ onto the outer tube wall in order to remove the lubricant from the outer tube wall, wherein, during the application of the liquid or solid $CO_2$ onto the outer tube wall, the temperature of the steel tube is measured and the cleaning is interrupted if the temperature of the steel tube falls below a predetermined temperature threshold.

2. The method according to claim 1, wherein the cleaning of the outer tube wall is performed by $CO_2$ snow blasting or by dry ice blasting.

3. The method according to claim 1, wherein the liquid or solid $CO_2$ is applied onto the outer tube wall by pressurized air.

4. The method according claim 1, wherein the liquid or solid $CO_2$ is applied in the form of a jet onto the outer tube wall, wherein a jet direction of the $CO_2$ is substantially perpendicular to the outer tube wall.

5. The method according to claim 4, wherein a temperature of the jet is measured in the jet direction of the liquid or solid $CO_2$ after the liquid or solid $CO_2$ has interacted with the outer tube wall of the steel tube.

6. The method according to claim 5, wherein a velocity of the liquid or solid $CO_2$ as it exits a feed line is regulated as a function of the temperature of the jet in the jet direction of the liquid or solid $CO_2$ after the liquid or solid $CO_2$ has interacted with the outer tube wall of the steel tube.

7. The method according to claim 1, wherein the steel tube is rotated during the cleaning under a jet of the liquid or solid $CO_2$ .

8. The method according to claim 1, wherein, during the cleaning, a jet of liquid or solid $CO_2$ is applied in a longitudinal direction over the outer wall of the steel tube.

9. A method for producing a steel tube comprising:

manufacturing the steel tube by forming a hollow shell into a form of a finished dimensioned steel tube by cold drawing the hollow shell into the form of the finished steel tube, the steel tube having an inner tube wall, an outer tube wall, and a free tube cross-section enclosed by the inner tube wall, wherein after the manufacturing, the steel tube on the outer tube wall includes at least one contaminant, the at least one contaminant being a drawing oil transferred from a die to the outer tube wall;

cleaning the outer tube wall by applying liquid or solid $CO_2$ onto the outer tube wall in order to remove the drawing oil from the outer tube wall;

measuring a temperature of the steel tube during cleaning; and interrupting the cleaning when the measured temperature of the steel tube is below a predetermined temperature threshold.

10. The method according claim 9, wherein the liquid or solid $CO_2$ is applied in the form of a jet onto the outer tube wall, wherein a jet direction of the $CO_2$ is substantially perpendicular to the outer tube wall.

11. The method according to claim 10, wherein a temperature of the jet is measured in the jet direction of the liquid or solid $CO_2$ after the liquid or solid $CO_2$ has interacted with the outer tube wall of the steel tube.

12. The method according to claim 11, wherein a velocity of the liquid or solid $CO_2$ as it exits a feed line is regulated as a function of the temperature of the jet in the jet direction of the liquid or solid $CO_2$ after the liquid or solid $CO_2$ has interacted with the outer tube wall of the steel tube.

13. A method for producing a steel tube comprising:

manufacturing the steel tube by forming a hollow shell into a form of a finished dimensioned steel tube by cold pilgering, the steel tube having an inner tube wall, an outer tube wall, and a free tube cross-section enclosed by the inner tube wall, wherein after the manufacturing, the steel tube on the outer tube wall includes at least one contaminant, the at least one contaminant being a lubricant transferred from a roll to the outer tube wall; and cleaning the outer tube wall of the steel tube by applying liquid or solid $CO_2$ onto the outer tube wall in order to remove the lubricant from the outer tube wall;

wherein the liquid or solid $CO_2$ is applied in the form of a jet onto the outer tube wall, wherein a jet direction of the $CO_2$ is substantially perpendicular to the outer tube wall., wherein a temperature of the jet is measured in the jet direction of the liquid or solid $CO_2$ after the liquid or solid $CO_2$ has interacted with the outer tube wall of the steel tube, and wherein a velocity of the liquid or solid $CO_2$ as it exits a feed line is regulated as a function of the temperature of the jet in the jet direction of the liquid or solid $CO_2$ after the liquid or solid $CO_2$ has interacted with the outer tube wall of the steel tube.

* * * * *